US005388357A

United States Patent [19]

Malita

[11] Patent Number: 5,388,357

[45] Date of Patent: Feb. 14, 1995

[54] KIT USING LED UNITS FOR RETROFITTING ILLUMINATED SIGNS

[75] Inventor: Mark Malita, Annandale, N.J.

[73] Assignee: Computer Power Inc., High Bridge, N.J.

[21] Appl. No.: 45,483

[22] Filed: Apr. 8, 1993

[51] Int. Cl.[6] ..... G09F 13/04

[52] U.S. Cl. ..... 40/570; 40/544; 362/812

[58] Field of Search ..... 40/570, 542, 544, 580, 40/564; 362/235, 247, 800, 812

[56] References Cited

U.S. PATENT DOCUMENTS

| | | | |
|---|---|---|---|
| 1,724,243 | 8/1929 | Willey . | |
| 1,761,868 | 6/1930 | Burke | 40/580 |
| 2,216,424 | 10/1940 | Stehlin | 40/580 |
| 3,324,290 | 6/1967 | Lasker . | |
| 4,211,955 | 7/1980 | Ray | 362/800 X |
| 4,271,621 | 6/1981 | Garcia et al. | 40/570 |
| 4,561,203 | 12/1985 | MacDonald, Jr. et al. | 40/570 |
| 4,628,422 | 12/1986 | Ewald | 362/812 X |
| 4,682,147 | 7/1987 | Bowman . | |
| 5,018,290 | 5/1991 | Kozek et al. | 40/570 |
| 5,105,568 | 4/1992 | Branning | 40/570 |

FOREIGN PATENT DOCUMENTS

| | | | |
|---|---|---|---|
| 2586844 | 3/1987 | France | 40/544 |

OTHER PUBLICATIONS

Lumacell, Inc., Scarborough, Ontario (advertising brochure, estimated publication, Spring, 1993).

Flexlite, Inc., Edison, N.J. (advertising brochure, Publication date unknown).

Electrodex, Inc., East Bradenton, Fla. (advertising brochure, estimated publication date-early 1989).

*Primary Examiner*—James R. Brittain
*Assistant Examiner*—Joanne Silbermann
*Attorney, Agent, or Firm*—Darby & Darby

[57] ABSTRACT

A kit retrofits a conventional exit sign, which normally uses internally mounted incandescent or fluorescent lamps, to operate using multiple LED sources in a group or assembly on a board. Indicia lighting is accomplished substantially indirectly through reflection of light from the LED sources. The LED source is electrically powered through an adapter that fits into the socket of the original incandescent lamp or fluorescent lamp, which is removed in the retrofit process. Metalized plastic light reflective panels are provided in the kit for adhesively connecting to inner surfaces of the enclosure for improved lighting efficiency of the indicia. Reduction of energy consumption by 10 or 20 times is coupled with virtually zero maintenance costs over long periods of time.

24 Claims, 3 Drawing Sheets

KIT USING LED UNITS FOR RETROFITTING ILLUMINATED SIGNS

FIELD OF THE INVENTION

This invention relates generally to illuminated signs and, more particularly, to exit type signs which are used in buildings to mark exits and pathways to such exits.

BACKGROUND OF THE INVENTION

It is common in hallways and entrances in public and commercial buildings, and in offices, to have signs delineating a path to an exit. These signs are generally illuminated with red or green letters and arrows to give building occupants a constant reminder of the location of an exit if an emergency should occur. These signs generally comprise a rectangular enclosure having a mask or stencil that is cut out to provide the desired indicia, for example, the words "exit", "stairs", "restroom" etc. The mask is backed by a translucent colored panel, and generally an incandescent or fluorescent lamp within the enclosure provides the mostly direct light energy that passes through the translucent panel and illuminates only the pattern of indicia for external viewing. This sign may be one sided or two sided.

When the internal incandescent or fluorescent lamps burn out, they must be replaced. This occurs with relative frequency as the exit-type sign is generally in continuous use, 24 hours a day, seven days a week, 8700 hours per year. Incandescent lamps as used in conventional exit signs have a life expectancy on the order of 10,000 hours and fluorescent bulbs have a life expectancy of approximately 20,000 hours. In a larger building where there are many exit signs, and signs leading to exits, as well as other exit-type signs replacement of bulbs is an ongoing task, and an expensive one.

In addition to the high maintenance requirements for conventional incandescent and fluorescent signs, power consumption is a significant factor, especially in large structures where there are many, many signs. The total power consumed by exit signs alone in the U.S.A. is estimated to be in excess of 20 million megawatt-hours per year.

Thus, it would be of great benefit to building owners and the country in general, to reduce the power consumption by a factor of at least 10 or 20 times. As a result of the cumulatively high cost, maintenance of the exit signs is frequently neglected and a sign which is designed to operate with two lamps is frequently left to operate with one lamp or even no lamps for a period of time. Single lamp operations of such signs results in uneven lighting of the indicia as well as a lower overall level of lighting and visibility.

What is needed is a way to modify all existing incandescent and florescent illuminated exit-type signs in a way that conserves manpower, materials and most of all energy, but has a cost which insures the shortest payback periods of the capital investment in the conversion.

SUMMARY OF THE INVENTION

It is an object of the invention to provide an improved illuminated exit-type sign having a very long operating life without bulb maintenance.

It is a further object of the invention to provide an improved illuminated exit-type sign having very low energy consumption, and hence a low cost of operation.

It is yet another object of the invention to provide a low maintenance, energy efficient, easily installed, improved, light emitting diode (LED) illuminated exit-type sign by using a retrofit kit that is adaptable to nearly all incandescent and florescent exit signs presently in use.

A further object of the invention is to provide a retrofit kit that can be used for converting a conventional high energy consumption exit-type sign for longer, more economical life without removing the sign from its mounting.

Still another object of the invention is to provide an improved illuminated exit-type sign by means of a retrofit kit that uses LED elements operating on the identical power source as the original sign.

Another object of the invention is to provide an improved exit-type illuminated sign which is retrofit from a conventional exit-type sign that uses incandescent or fluorescent lighting.

In accordance with a preferred embodiment of the invention, a conventional exit sign, which uses internally mounted incandescent or fluorescent lamps, is retrofit, that is, converted to operate using LED units arranged for mounting like a conventional light source. A substantial portion of the indicia lighting energy is transmitted to the indicia from the light source, mostly indirectly through reflection of light from a LED source. This source may be, but is not limited to, a line of LED elements mounted on a circuit board. The LED board is electrically powered by means of an adapter that is powered from the socket of the original incandescent lamp or fluorescent lamp, which is removed in the retrofit process. Thus, no change in power source is needed in converting a conventional incandescent or florescent sign to use a LED light source.

Light reflective panels are provided within the sign enclosure in the form of metalized plastic which is adhesively connected to one or more inner surfaces of the enclosure to provide the indirect lighting from the LED source to the indicia.

In an exemplary embodiment, light boards or bars are positioned at opposite ends of the enclosure, substantially at right angles to the indicia. The back of the enclosure is covered with a reflective coating that faces the inner surface of the indicia mask and translucent panel of the original construction. Light from the light bars reflects from the rear panel and falls on the inner surface of the indicia mask. Some light from the light bars also impinges directly on the inner surface of the mask. As viewed externally, the indicia glow with substantial uniformity of light intensity as a result of the diffusing effect produced when the light falls on the rear surface and reflects.

Newly manufactured signs of similar construction, that is, not retrofits of incandescent or fluorescent signs, include similar features, with LED lights strategically positioned within the enclosure to provide direct and indirect lighting to the indicia.

These constructions using LED units have extremely long operational life. The life expectancy of light emitting diodes exceeds 800,000 hours. The LED light boards operate from the same electrical power, generally 120 volt/60 cycle a.c., or from d.c., as do conventional incandescent and fluorescent lamps.

Further objects and advantages of the invention will be apparent from the following detailed description and drawings. The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description of the presently preferred embodiments, taken in connection with the accompanying drawings, in which.

DESCRIPTION OF THE PREFERRED EMBODIMENTS

Figure 1:
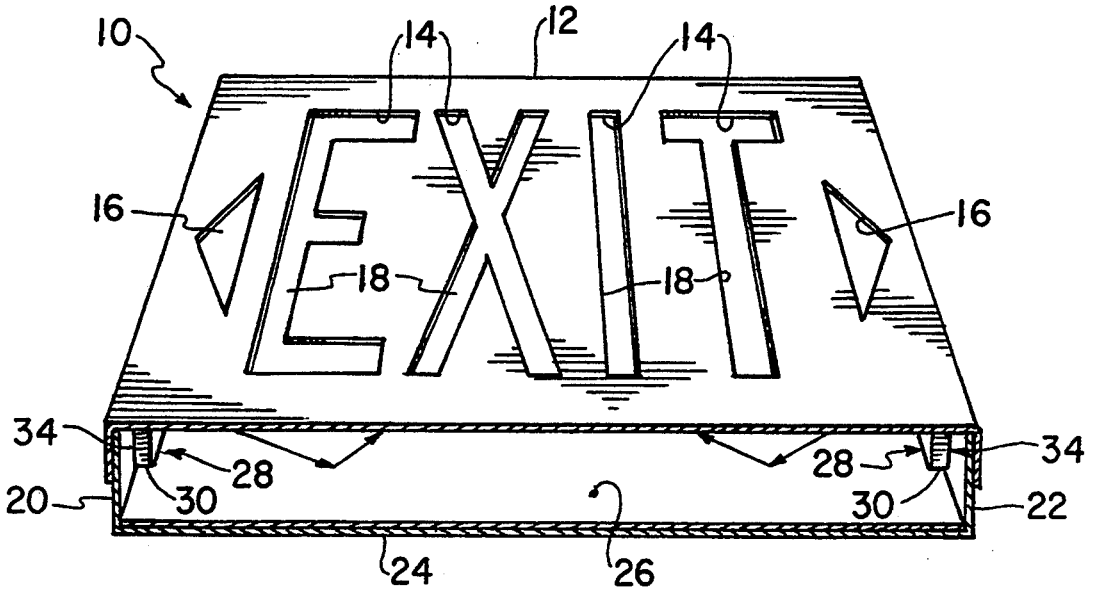
FIG. 1 is a conventional exit sign in perspective, with the bottom removed to show a retrofit in accordance with the invention.
Figure 2:
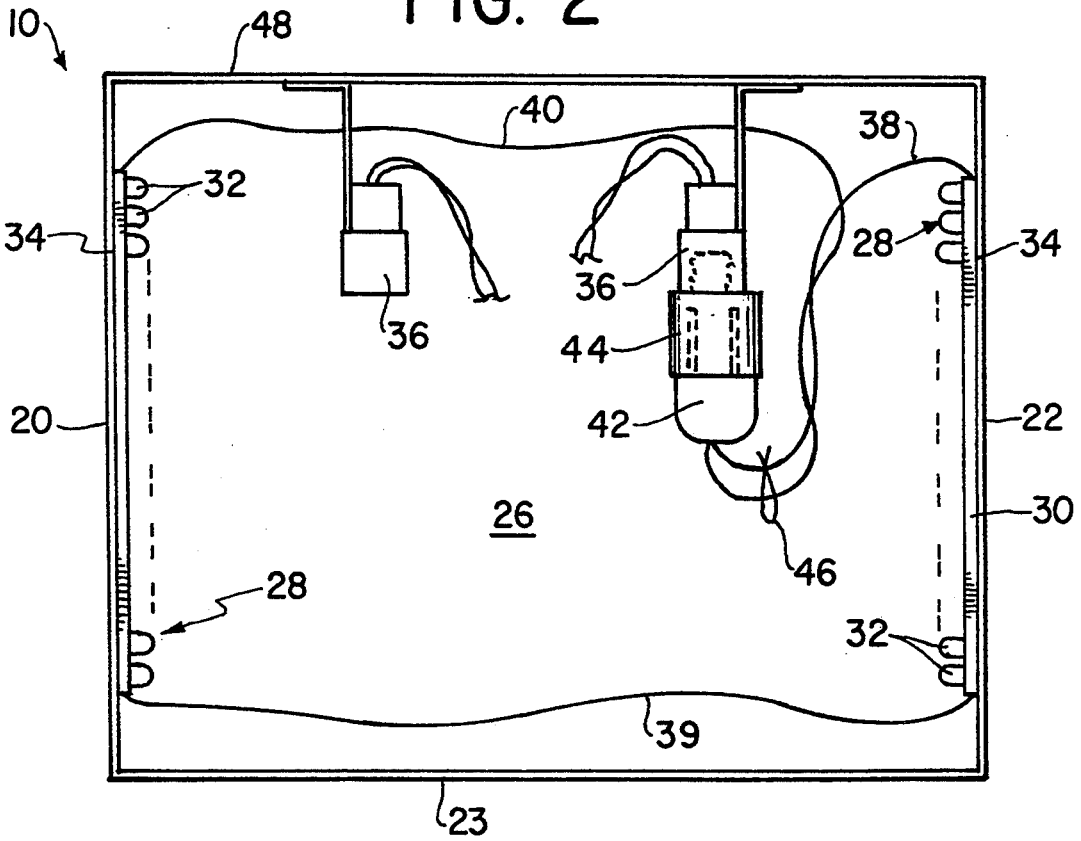
FIG. 2 is a front elevational view of the sign of FIG. 1 with the indicia panel removed to show the retrofit in accordance with the invention.

FIGS. 1 and 2 illustrate a conventional illuminated exit sign 10, which has been modified by retrofit in accordance with the invention. The sign 10, which is illustrated without a bottom panel in FIG. 1 to expose a portion of the interior, is of generally rectangular configuration and includes a front or display panel 12, which is cut out in the form of an opaque mask or stencil to provide indicia 14, in this case, thick letters making the word "EXIT". Supplemental indicia 16 are also formed into the display panel 12, which indicia frequently are in the form of arrowheads to indicate a direction toward an exit. The indicia 16 are mirror images in the embodiment of FIG. 1, as would be used where the sign is located at the exit itself.

Conventionally, the display panel 12, or at least the indicia 14,16, is backed by a translucent panel 18, which is generally red in exit signs but may also be green. Other colors are frequently used in signs having different applications, for example, in hotels to identify large assembly and ball rooms or services, such as garment checking. In some exit signs, the translucent panel 18 may be positioned outside the display panel 12, that is, outside the stencil or mask and in other signs, the stencil or mask may be sandwiched between two translucent panels. In any construction, light within the exit sign 10 passes through the translucent portions in a pattern of indicia defined by the stencil or mask 12, such that the indicia are illuminated.

The sign 10 further includes a left side panel 20, a right side panel 22 bottom panel 23 and a rear panel 24. A highly reflective surface 26 is provided on the inside of the rear panel 24 facing the inner side of the display panel 12. The highly reflective surface 26 is produced by the rear panel itself having a highly reflective surface, or the highly reflective surface 26 is provided by adding a reflective layer onto the rear panel 24. In retrofitting a conventional sign in accordance with the invention, a sheet of metalized plastic can be adhered by its backside to the inner surface of the rear panel 24. Alternatively, a sheet of metal foil, for example, aluminum, can be adhered to the inner surface of the rear panel 24. The metal foil can be provided with adhesive on its backside or the adhesive can be applied on-site, for example with a brush, prior to attaching the metallic foil. A pressure contact-type foil is a preferred construction as is a pressure-type metalized plastic film.

Light boards or light bars 28 are mounted at the side panels 20,22 and include a mounting board 30, for example, an elongated strip of printed circuit board material, to which a plurality of light emitting diodes (LED) 32 are wired. The light emitting diodes 32 are electrically connected in series, series/parallel, or parallel to accommodate the operating voltage of the devices and the power supply which is being used. As the LED devices are diodes, which rectify an a.c. voltage, the light board 28 can be used with either a d.c. source such as a battery or can be operated from conventional 110 volt, 60 cycle a.c.

Figure 4:
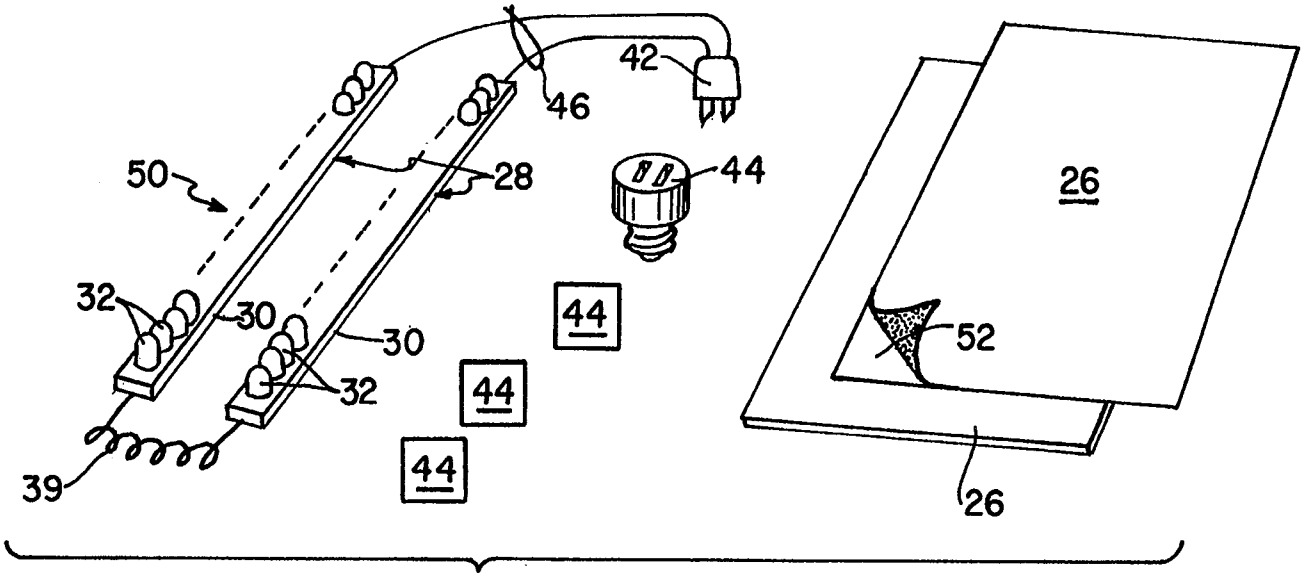
FIG. 4 is a simplified view of a retrofit kit for an illuminated sign in accordance with the invention.
Figure 3:
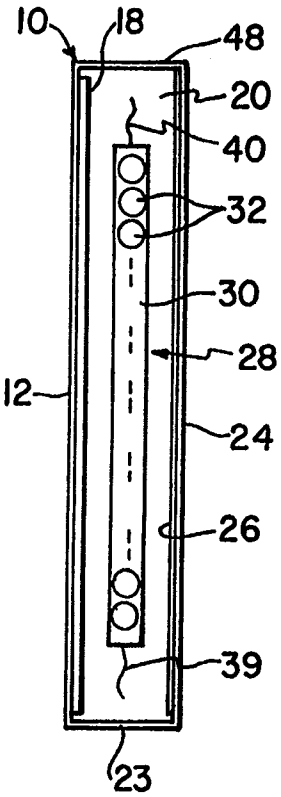
FIG. 3 is a front view of an LED light source mounted on a PC board, in accordance with the invention.

When using 110 volt, 60 cycle a.c., 15 to 20 LEDs of a minimum brilliance of 1,000 mille candellas on each light bar 28 are required to produce a suitable light output to light the word "exit" when the letters are a minimum of 6 inches high, as required by the National Fire Protection Association. Such a light bar 28, fabricated on printed circuit board material may have a length on the order of 6 inches and a width of $\frac{1}{4}$ inches. The thickness of the printed circuit board material is conventional, that is, on the order of 0.10 inches thick. The LED units 32 are arranged on the mounting board 30 in a generally linear pattern, as illustrated in FIGS. 2 to 4. The light boards 28 are attached to the side panels 20,22 by fastening means an adhesive 34 on the back of the light board 28. The light bar 28 is pressed against the side panel and sticks on contact or an adhesive is spread on the backside of the mounting board 30 and then the mounting board is pressed against the respective side panel 22,24.

As illustrated in FIG. 2, the sign 10 is fitted with a pair of electrical receptors or sockets 36 which were used originally with incandescent bulbs (not shown) for illumination of the indicia. These incandescent bulbs are removed before the enclosure is retrofitted in accordance with the invention.

A circuit for the light bars 28 includes a wire 38 connected to a first LED on the right side bar 28 (FIG. 2), a second and third wire 39 connected between the right hand light board 28 and the left hand light bar 28, and a return wire 40. The wires 38–40 connect into a conventional two-prong electrical plug 42 that plugs into an adaptor 44. The adaptor is threaded into one of the two sockets 36 where the incandescent lamps were originally connected. Other types of connection, for example, an in-line type, between the wires 38–40 and an adaptor may be used in alternative embodiments. Thus, the adaptor 44 has two sets of contacts, that is, a set of contacts for engaging the socket and a set of contacts for engaging the light bar.

Thus, when the sign 10 is connected by a power line to a conventional power source (not shown) that energizes the sockets 36, the light boards 28 are energized and the light emitting diode units 32 generate light in a selected color.

It should be understood that each light board 28 may be separately wired so that one light board 28 is connected to one socket 36 and the other light board 28 is connected (not shown) to the other socket 36.

As best illustrated in FIG. 1, light from the diodes 32 impinges directly onto the inner surface of the translucent panel 18, but also reflects from the highly reflective surface 26 on the backside 24 of the sign enclosure. This reflected light also impinges on the backside of the translucent panel 18. When the diodes are energized, and the sign is viewed from the outside of the display panel 12, the cutout portions 14 of the generally opaque panel 12 are illuminated from within the sign, whereas the remaining portions of the display panel 12 are dark by contrast. The indicia 14 and 16 are both illuminated in the illustrated embodiment.

Although the sign in FIGS. 1 and 2 is illustrated without a bottom panel 23, this panel can also be made highly reflective on the inside, as can the top panel 48 by use of foil, metalized plastic sheet, and the like.

Additionally, in alternative embodiments, the inner surface of the translucent panel 18 can be given a highly reflective coating, except those portions that are directly aligned with the indicia 14,16. The side panels 20,22 can have internal surfaces that are highly reflective before the light bars 28 are positioned. As a further alternative, the translucent panel 18 can be made with a phosphorescent material that amplifies the light, showing the stenciled word "exit". In other words, the degree of reflectance or light generation within the enclosure of the sign 10 can be modified to meet particular lighting requirements. For example, larger enclosures would benefit from additional reflective surfaces when the light bars 28 are standardized with the intention that a single light bar configuration may serve in many different signs.

In this regard, a kit 50 (FIG. 4) for converting a conventional exit sign using incandescent lamps to a sign in accordance with the invention using light emitting diode units, would include a pair of light bars 28 connected in series by a wire 39 and connected at their respective ends by a line 46 to the electrical plug 42. Alternatively, in the kit, the wires might not be cut to length and quick-connect devices, as are conventional in the art, could be provided for these LEDs on the light bars 28, so that the wires can be cut to length and quickly installed when a retrofit is made. One or more capacitors and/or resistors (not shown) as required for proper operation of LEDs, would be included in the kit. Preferably, because exit signs do not vary greatly in size, the light bars 28 can be completely wired to the plug 42 and to each other in the kit—ready to use.

Also, the kit provides a plurality of adaptors. Ninety nine percent of exit signs use incandescent lamps and there are four different, standard lamp bases that are in general use for these applications. Accordingly, an all-purpose retrofit kit includes at least one of each of the four different adaptors. Thus, an installer can buy the kit and proceed to the site where a retrofit is to be made with confidence that the kit will be suitable.

Where both sockets 36 are to be used in a sign for connecting independent light boards 28, the quantity of adaptors 44 and plugs 42, etc. provided in a kit is doubled.

Also included in the kit are several pre-cut panels 26 of highly reflective material, although the quantity of reflective panels need not be limited to two as illustrated in FIG. 4. Preferably, the panels 26 are thin sheets of plastic which have been metalized in a conventional manner. The backsides, that is, the nonreflecting sides of the sheets 26 are coated with a contact adhesive which is covered by a release paper 52. After removing the release paper from the sheet 26, the sheet is guided into the exit sign enclosure and adhesively pressed onto the rear panel 24. Because the metalized plastic materials and thin metallic foils, which may also be used as the reflector 26 (FIG. 4), are easily cut with scissors, a knife, a utility knife having a razor blade, etc., additional reflective panels can be added on the inner surfaces of the enclosure at the top and bottom and on the side panels, as discussed above, by cutting down a larger sheet provided in the kit. The reflective sheet may also be provided in rolled-up form.

The light bars 28 in the kit also have adhesive on their backsides. In the kit, this adhesive surface is covered with a release paper. To install the light bars 28 in the enclosure of the sign 10, the release paper is removed from the backs of the mounting boards 30 and the light bars 28 are pressed onto respective side panels 22,24. Then, the adaptor 44, of proper size, is threaded into the socket 36 in the enclosure and the plug 42, connected to the light bars 28, is inserted into the adaptor 44.

The entire retrofitting procedures from unscrewing the original incandescent lamps to the connection of the plug 42 into the adaptor 44, can be accomplished without disconnecting the power from the sign when the retrofit is done on-site.

Additional adaptors are required for those infrequent situations where the existing exit signs operate on fluorescent lighting. In such a case, adaptors suitable to connect to the sockets previously used by the fluorescent lamp are required in the kit, or can be provided as a special hardware package for kits intended for conversion of fluorescent-type exit signs.

Because the light emitting diodes provide a high intensity of light and because the lighting effect is produced in large part by reflection which comes from many angles, it is not necessary that the LED units be configured on the light bars in any pattern that corresponds to any particular indicia. There is no need to form a pattern of the light emitting units 32 in the shape of the letter "E" or "X", etc. Thus, a standardized light bar 28 with reflector panels/sheets and electrical fittings, form a universal-type kit that can be used in many signs of generally similar size and configuration. As indicated above, somewhat larger signs can be accommodated by increasing the number of reflecting surfaces within the sign enclosure.

Additionally, series-parallel electrical arrangements can be provided so that in alternative embodiments of the invention, three or four standardized light bars 28 may be used in a sign enclosure, or greater numbers, as the particular installation requires. The number of light emitting diode units 32 connected in series depends upon the power source and the voltage drop required in each individual LED for proper light output. In order to minimize power consumption, it is preferable to reduce or avoid, if possible, the use of ballasts and internal resistors. It should also be recognized that in time the voltage and current requirement of light emitting diodes may change as new materials are developed.

In the embodiment of FIG. 4, the LED light bars 28 are connected into a socket of an incandescent lamp or fluorescent lamp which has been removed, as described above, when a retrofit is made. On the other hand, when the sign is not a retrofit, the light bars 28 are connected directly to the power source just as the incandescent or fluorescent lamps would be connected in the prior art.

Figure 5:
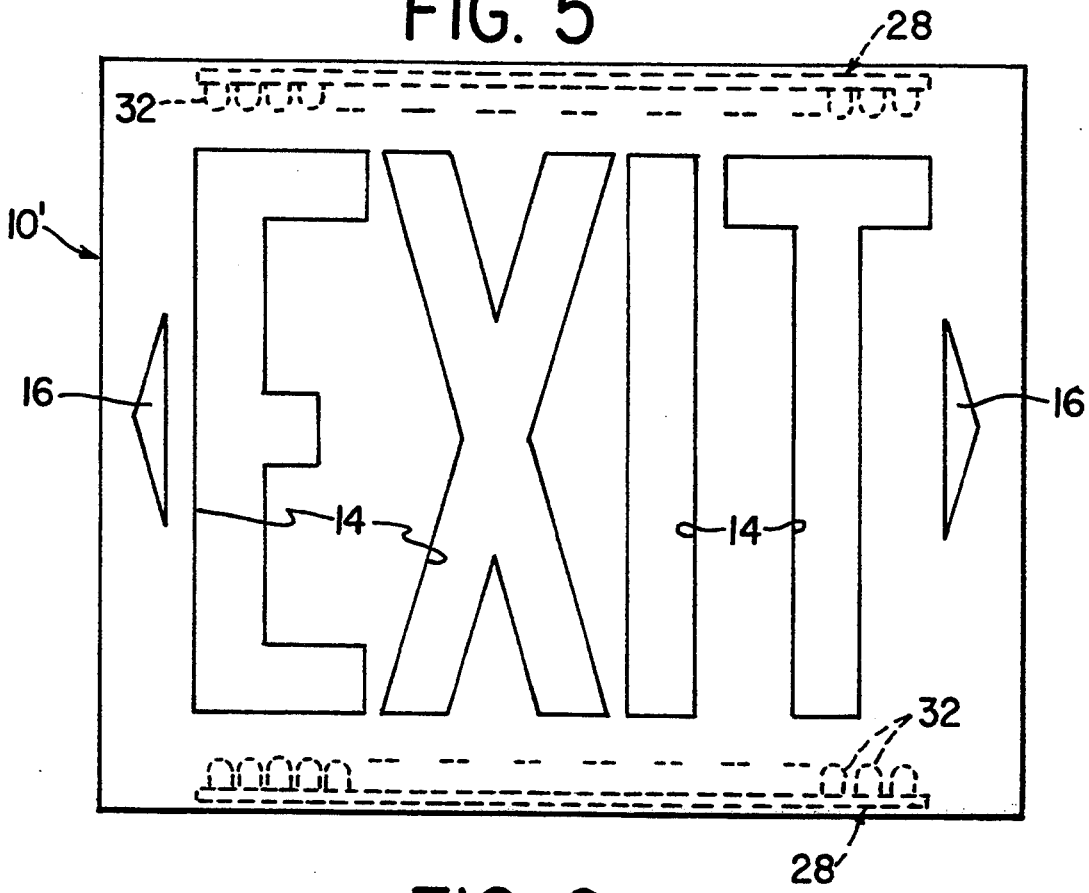
FIG. 5 is an alternative embodiment of an exit-type illuminated sign in accordance with the invention.

FIG. 5 illustrates an alternative embodiment of a sign 10' in accordance with the invention, wherein the standardized light bars 28 are located on the top panel and bottom panel of the sign enclosure. In such an embodiment, the rear panel is covered with a highly reflective surface. Depending upon the size of the sign, reflective surfaces may also be used on the right and left side panels, respectively. Additionally, a reflective surface (not shown) can be added on the inside of the translucent panel with cut-out portions aligned with the indicia so that light is transmitted through the indicia to the outside of the sign, but the remaining surface of the translucent panel or mask, whichever is innermost, is used as a reflector.

Figure 6:
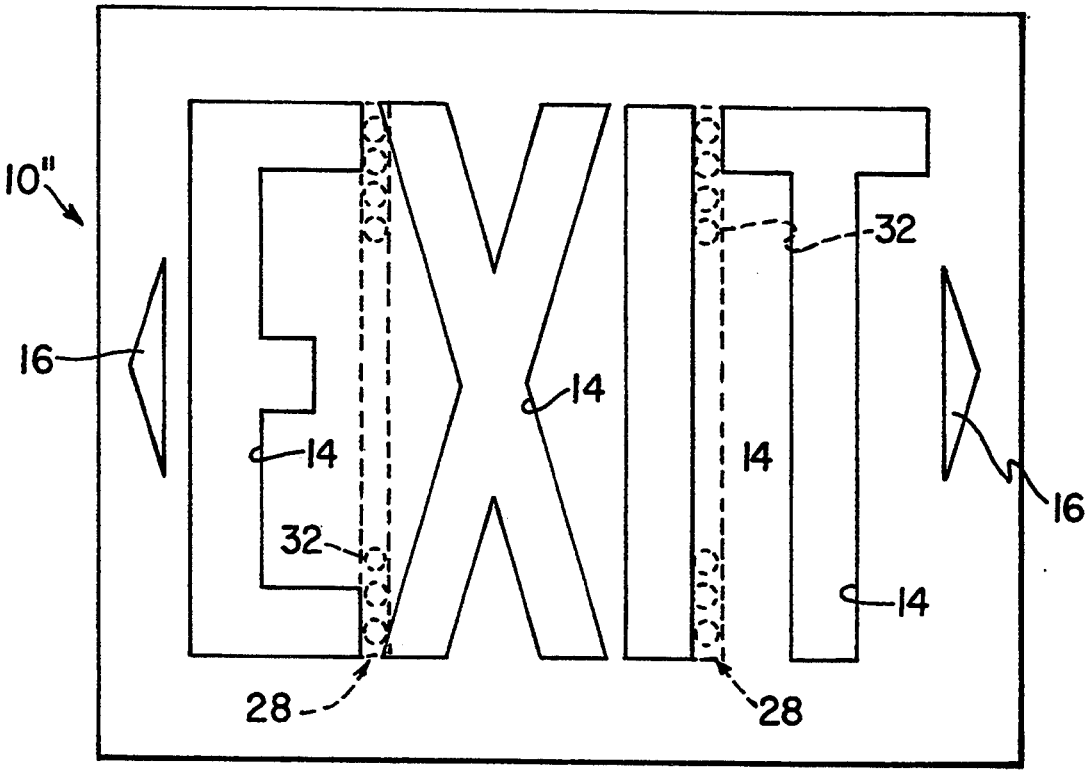
FIG. 6 is another alternative embodiment of an exit-type illuminated sign in accordance with the invention.

FIG. 6 illustrates an alternative embodiment of an illuminated exit-type sign 10" in accordance with the invention. Therein, the standardized light bars 28 are attached to the translucent panel or to the mask, whichever is innermost, at locations that do not overlap the indicia 14,16 of the sign. The light emitting diodes 32 of the light bars 28 face the rear panel 24 which is made highly reflective as in the embodiments above. In operation, light from the light bars reflects from the rear panel to illuminate the indicia. In larger signs or with LED units of lesser intensity, the reflective surfaces on the rear panels are supplemented with reflective surfaces that can be positioned on any of the side, top and bottom panels, or on all of these panels. Again, the light bars can be connected to the sockets where incandescent or fluorescent lamps were used before the retrofit is made. Alternatively, a sign, not a retrofit, can be constructed as illustrated in FIG. 6 wherein the light bars are connected directly to the same power source wiring as would be used for incandescent or fluorescent lamps in the prior art.

Figure 7C:
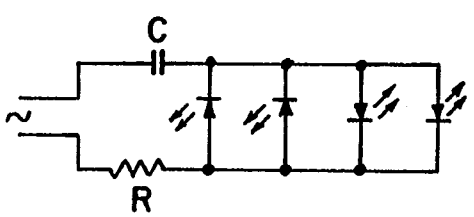
FIGS. 7A–C show electrical circuit diagrams for use in a sign in accordance with the invention.
Figure 7B:
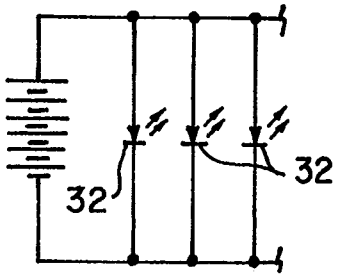
Figure 7A:
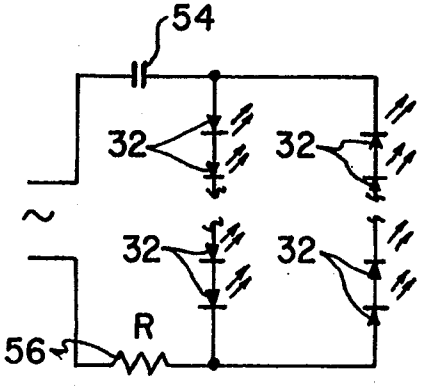

When connecting to conventional 60 cycle, 110 volts a.c., the LED units on each light bar may be connected in parallel (FIG. 7A). In such a construction (or in an entirely series arrangement), it may be necessary to also place a capacitor 54 and/or a resistor 56 in series with the strings of LED units as a voltage dropping device so that in normal use excessive voltage is not applied to the individual LED units. Use of a resistor 56 is preferred, and serves as a current limiter and surge protector against voltage spikes and surges as may occur on the external power source lines. A 300 ohm, 0.5 watt resistor has operated satisfactorily in a 110 volt, 60 cycle a.c. application.

Because the LED units are ON for one half cycle and OFF for one half cycle of the a.c. voltage, it is desirable where two light bars are used in a sign, to have the light bars operate 180 degrees out of phase with each other (FIG. 7A). This reduces flicker, which is imperceptible after the diffusion of light from the reflecting surfaces.

If the sign is to operate from a d.c. source, for example, a low voltage battery, the LED units can be wired in parallel (FIG. 7B) or series parallel combinations to provide the proper voltage on each LED unit. In a d.c. construction, a capacitor is not used. However, using a capacitor in the a.c. applications provides an effective voltage reducer that does not consume power. FIG. 7C illustrates another a.c. circuit for operation of parallel LED units using a voltage dropping capacitor and a resistor.

A sign which is 7 inches high by 12 inches long and 2 inches deep, and has exit indicia 6 inches high and three quarters of an inch wide on one side, is adequately illuminated to required national standards by two separately wired light boards, each having 16 LED units in two parallel branches of 8 units. Power consumption in operation is approximately one watt.

It should be understood, that whereas a conventional male plug is illustrated and described for connection to the adaptor 44, any suitable connection arrangement can be used to connect the light board 28 to adaptor 44.

Also, a plurality of kit types may be provided to include only one adaptor respectively, so that a purchaser may select the kit type that is required for the particular sign conversion, which is to be made.

Additionally, a standardized kit may contain no adaptor. The purchaser may concurrently buys a kit and the adaptor required for the intended sign conversion.

In all of the embodiments in accordance with the invention, a standardized light bar may be used. This greatly reduces production costs and reduces warehousing requirements when preparing kits for sale and distribution.

The final result of the retrofit according to the present invention is a reduction of energy consumption by 10 or 20 times coupled with virtually zero bulb maintenance costs over long periods of time.

It will thus be seen that the objects set forth above, and those made apparent from the preceding description, are efficiently attained and, since certain changes may be made in the construction without departing from the spirit or the scope of the invention, it is intended that all matter contained in the above description, or shown in the accompanying drawings shall be interpreted as illustrative and not in a limiting sense.

What is claimed is

1. An illuminated sign, comprising:

a housing with a display panel at the front, said display panel having a translucent portion defining at least one indicia, said indicia being visible outside said at least when said sign is illuminated;

at least one LBD light source in said housing, said at least one light source including a plurality of light emitting diodes that generate light when supplied with electrical energy, said at least one light source including a base having a first face with said plurality of light emitting diodes mounted on said first face;

fastening means, said at least one light source being positioned in said housing by said fastening means;

reflector means within said housing for receiving light from said at least one light source and reflecting at least a portion of said received light onto said display panel, whereby said indicia are illuminated and visible externally of said housing; and electrical connection means for connecting said at least one light source to an electrical power supply so as to selectively supply electrical energy to said at least light source, said electrical connection means including a socket within said housing for one of an incandescent lamp and a fluorescent lamp, and said electrical connection means further including electrical adaptor means positioned between said socket and said light source for electrically and mechanically engaging both said socket and also said at least one light source to bring electrical power to said at least one light source when power is made available at said socket, said electrical adaptor means including means for engaging said socket and a female receptacle, said electrical connection means further including a plug connected electrically to said at least one light source, said plug having contacts for engagement in said female receptacle.

2. An illuminated sign as in claim 1, wherein the housing includes a back panel with an interior surface, and there are at least two light sources, said reflector means includes one of a reflective interior surface on said back panel and a reflective material mounted to said interior surface.

3. An illuminated sign as in claim 2, wherein said reflector means is said reflective material, said reflective material being mounted to said back panel by adhesive means positioned between said back panel and said reflective material for fixing the location of said reflector means in said housing.

4. An illuminated sign as in claim 3, wherein said reflective material includes a sheet having a reflective face and having said adhesive means on the opposite face of said sheet.

5. An illuminated signs as in claim 2, further comprising a bottom panel, wherein one of said light sources is positioned adjacent said top panel and one of said light sources is positioned adjacent said bottom panel.

6. An illuminated sign as in claim 2, wherein, said reflector means includes one of a reflective interior surface of said back panel and a reflective material mounted to said interior surface of said back panel, said at least one light board being positioned on an inside surface of said display panel with said diodes facing said back panel.

7. An illuminated sign as in claim 2, wherein said further includes side panels, one of said two light sources being positioned adjacent each of said side panels.

8. An illuminated sign as in claim 2, wherein said housing further comprises a bottom, and side panels, and further including surfaces on at least one of said top panel, bottom panel, side panels, and an surface of said display panel.

9. An illuminated sign as in claim 1, wherein each of said plurality of light emitting diodes is electrically connected in series.

10. An illuminated sign as in claim 1, wherein the number of light sources is at least two and said at least two sources are connected to operate 180 degrees out of phase with each other when said sign is to be powered from an a.c. source, whereby illumination is provided at a steady level.

11. An illuminated sign as in claim 1, wherein said display panel includes at least a mask with indicia openings thereon, and a translucent panel positioned adjacent to said mask.

12. An illuminated sign as in claim 1, wherein at least one of a capacitor and a resistor is connected in series with said at least one LED light source.

13. An illuminated sign as in claim 1, wherein all of said light sources are connected to emit light simultaneously, said sign being operable on AC and DC voltage.

14. An illuminated sign as in claim 1, wherein said adaptor includes first contact means for connecting with said at least one light source, said adaptor means further including second contact means connected to said at least one light source for electrically connecting with said first contact means of said adaptor.

15. The illuminated sign as in claim 1 wherein the base is a longitudinal strip with at least some of said light emitting diodes aligned one behind the other along said longitudinal strip.

16. The illuminated sign as in claim 1 wherein the plug is connected to the light source by flexible wires.

17. A kit of parts for retrofitting an illuminated exit-type sign having a housing with a display panel, said display panel including a translucent portion defining at least one indicia, said indicia being visible outside said sign at least when said sign is illuminated, and a lamp socket mounted within said housing for connection with a lamp, said kit retrofitting said sign without removal of said socket, said kit of parts comprising:

at least one LED light source, each said light source including a plurality of light emitting diodes; and electrical connection means for electrically connecting said at least one light source to said socket in said housing, said electrical connection means includes a plurality of adaptors, each said adaptor being compatible for connection with a different type of lamp socket.

18. A kit as in claim 17, wherein each of said adapters includes similar first contact means, said electrical connection means further including second contact means suitable for engagement with said first contact means, said second contact means being connected to said at least one light source and connectable to each of said adapters to bring electrical power to said at least one light source when power is made available at said socket.

19. A kit of parts for retrofitting an illuminated exit-type sign having a housing with a display panel, said display panel including a translucent portion defining at least one indicia, said indicia being visible outside said sign at least when said sign is illuminated, and a socket mounted within said housing for connection with a lamp, said kit of parts comprising:

at least one LED light source, each said light source including a plurality of light emitting diodes;

fastening means for connection of said at least one light source to a surface within said housing; and electrical connecting means for connecting said at least one light source electrically to said socket in said housing, said electrical connection means including electrical adaptor means for positioning between said socket and said light source for electrically and mechanically engaging both said socket and also said at least one light source to bring electrical power to said at least one light source when power is made available at said socket, said electrical adaptor means including means for engaging said socket and a female receptacle, said electrical connection means further including a plug connected electrically to said at least one light source, said plug having contacts for engagement in said female receptacle.

20. A kit as in claim 19, wherein said fastening means is connected to said at least one light source.

21. An illuminated sign, comprising:

a housing with a display panel at the front, said display panel having a translucent portion defining at least one indicia, said indicia being visible outside said sign at least when said sign is illuminated;

at least one LED light source in said housing, said at least one light source including a plurality of light emitting diodes that generate light when supplied with electrical energy, said at least one light source including a base having a first face with said plurality of light emitting diodes mounted on said first face, said base being in the form of a longitudinal strip with at least some of said light emitting diodes aligned one behind the other along said longitudinal strip;

fastening means, said at least one light source being positioned in said housing by said fastening means;

electrical connection means for connecting said at least one light source to an electrical power supply so as to selectively supply electrical energy to said at least one light source, said electrical connection means including a socket within said housing, and said electrical connection means further including electrical adaptor means positioned between said socket and said light source for electrically and mechanically engaging both said socket and also said at least one light source to bring electrical power to said at least one light source when power is made available at said socket, said electrical adaptor means including means for engaging said socket and a female receptacle, said electrical connection means further including a plug connected electrically to said at least one light source by flexible wires, said plug having contacts for engagement in said female receptacle.

22. A kit of parts for retrofitting an illuminated exit-type sign having a housing with a display panel, said display panel including a translucent portion defining at least one indicia, said indicia being visible outside said sign at least when said sign is illuminated, and a lamp socket mounted within said housing for connection with a lamp, said kit retrofitting said sign without removal of said socket, said kit of parts comprising:

at least one LED light source, each said light source including a plurality of light emitting diodes, said at least one light source being in the form of a longitudinal strip with at least some of said light emitting diodes aligned one behind the other along said longitudinal strip;

electrical connection means for electrically connecting said at least one light source to said socket in said housing; and fastening means including adhesive located on a surface of the board for contacting a surface within said sign housing and mounting said board within said housing.

23. An illuminated sign, comprising:

a housing with a display panel at the front, said display panel having a translucent portion defining at least one indicia, said indicia being visible outside said sign at least when said sign is illuminated;

at least one LED light source in said housing, said at least one light source including a plurality of light emitting diodes that generate light when supplied with electrical energy, said at least one light source including a base having a first face with said plurality of light emitting diodes mounted on said first face, said base being the form of a longitudinal strip with at least some of said light emitting diodes aligned one behind the other along said longitudinal strip;

fastening means, said at least one light source being positioned in said housing and mounted directly on said housing by said fastening means; and electrical connection means for connecting said at least one light source to an electrical power supply so as to selectively supply electrical energy to said at least one light source.

24. A kit of parts for retrofitting an illuminated exit-type sign having a housing with a display panel, said display panel including a translucent portion defining at least one indicia, said indicia being visible outside said sign at least when said sign is illuminated, and a lamp socket mounted within said housing for connection with a lamp, said kit retrofitting said sign without removal of said socket, said kit of parts comprising:

at least one LED light source, each said light source including a plurality of light emitting diodes, said at least one light source being in the form of a longitudinal strip with at least some of said light emitting diodes aligned one behind the other along said longitudinal strip;

electrical connection means for electrically connecting said at least one light source to said socket in said housing; and fastening means for mounting said board within said housing directly on said housing.

* * * * *

UNITED STATES PATENT AND TRADEMARK OFFICE

CERTIFICATE OF CORRECTION

PATENT NO. : 5,388,357

DATED : February 14, 1995

INVENTOR(S) : Mark MALITA

It is certified that error appears in the above-indentified patent and that said Letters Patent is hereby corrected as shown below:

Column 8

In claim 1, line 36, before "at least", insert --sign--;

line 37, change "LBD" to --LED--.

Column 9

In claim 5, line 19, change "signs" to --sign--.

In claim 7, line 30, after "said" insert --housing--.

In claim 8, line 37, before "surface" insert --inside--.

line 1, change "board" to --longitudinal strip--.

UNITED STATES PATENT AND TRADEMARK OFFICE

CERTIFICATE OF CORRECTION

PATENT NO. : 5,388,357

DATED : February 14, 1995

INVENTOR(S) : Mark MALITA

It is certified that error appears in the above-indentified patent and that said Letters Patent is hereby corrected as shown below:

Column 12

In claim 24, line 43, delete "directly on said housing".

Signed and Sealed this

Twenty-third Day of May, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,388,357

DATED : February 14, 1995

INVENTOR(S) : Mark MALITA

It is certified that error appears in the above-indentified patent and that said Letters Patent is hereby corrected as shown below:

Col. 8 In claim 1, line 54, after "at least" insert--one--.

Col. 9 In claim 6, line 27, change "board" to --source--.

In claim 22, line 44 (col. 11), change "the board" to --said longitudinal strip--;

line 1 (col. 12), change "board" to --longitudinal strip--.

Col. 12 In claim 23, line 14, after "being" insert --in--.

In claim 24, line 42, change "board" to --longitudinal strip--;

line 43, change "directly on" to --and to--.

Signed and Sealed this

Twenty-first Day of May, 1996

*Attest:*

*Attesting Officer*

Bruce Lehman

BRUCE LEHMAN

*Commissioner of Patents and Trademarks*